US012241254B2

(12) United States Patent
Reuter et al.

(10) Patent No.: US 12,241,254 B2
(45) Date of Patent: Mar. 4, 2025

(54) PANEL ELEMENT FOR LINING A CEILING AND/OR WALL, AND LINING FOR A CEILING AND/OR WALL

(71) Applicant: durlum Group GmbH, Schopfheim (DE)

(72) Inventors: Matthias Reuter, Schopfheim (DE); Tobias Ruf, Schopfheim (DE)

(73) Assignee: durlum Group GmbH, Schopfheim (DE)

( * ) Notice: Subject to any disclaimer, the term of this patent is extended or adjusted under 35 U.S.C. 154(b) by 192 days.

(21) Appl. No.: 17/925,640

(22) PCT Filed: May 20, 2020

(86) PCT No.: PCT/EP2020/064185
§ 371 (c)(1),
(2) Date: Nov. 16, 2022

(87) PCT Pub. No.: WO2021/233544
PCT Pub. Date: Nov. 25, 2021

(65) Prior Publication Data

US 2023/0183984 A1 Jun. 15, 2023

(51) Int. Cl.

| | |
|---|---|
| ***E04B 9/06*** | (2006.01) |
| ***E04F 13/08*** | (2006.01) |
| *E04B 9/26* | (2006.01) |
| *E04F 13/12* | (2006.01) |

(52) U.S. Cl.
CPC ..... *E04F 13/0812* (2013.01); *E04B 9/26* (2013.01); *E04F 13/12* (2013.01)

(58) Field of Classification Search
CPC ..... E04F 13/0801; E04F 13/0803; E04F 13/0805; E04F 13/081; E04F 13/0812; E04F 13/0814; E04F 13/083; E04F 13/0832; E04F 13/0846; E04F 13/0851; E04F 13/0858; E04F 13/086; E04F 13/09; E04F 13/12; E04F 13/21; E04F 13/22; E04F 13/24; E04F 13/26; E04B 9/003; E04B 9/008; E04B 9/0428; E04B 9/0435; E04B 9/24; E04B 9/241; E04B 9/242; E04B 9/247; E04B 9/26; E04B 9/28
See application file for complete search history.

(56) References Cited

U.S. PATENT DOCUMENTS

| | | | | |
|---|---|---|---|---|
| 3,693,303 | A * | 9/1972 | Downing, Jr. | E04B 9/003 52/656.1 |
| 3,784,144 | A * | 1/1974 | Ollinger | E04B 9/18 248/317 |
| 4,408,428 | A * | 10/1983 | Brooke | E04B 9/242 52/506.07 |
| 4,438,613 | A * | 3/1984 | Hintsa | E04B 9/14 52/800.11 |

(Continued)

FOREIGN PATENT DOCUMENTS

| | | |
|---|---|---|
| WO | 2015183632 | 12/2015 |

*Primary Examiner* — Kyle J. Walraed-Sullivan
(74) *Attorney, Agent, or Firm* — Volpe Koenig

(57) ABSTRACT

Panel elements for lining ceilings and/or walls are provided. Here, a panel element (1), among others, is proposed, having a holding device (4) that is used to fix at least one holding spring (3), which is used to secure the panel element (1) to the ceiling and/or wall, in the transport position of the holding spring.

20 Claims, 3 Drawing Sheets

(56) References Cited

U.S. PATENT DOCUMENTS

| | | | | |
|---|---|---|---|---|
| 4,548,010 | A * | 10/1985 | Hintsa | E04B 9/26 52/800.11 |
| 5,428,930 | A * | 7/1995 | Bagley | E04B 9/003 52/489.1 |
| 7,909,297 | B1 * | 3/2011 | Harris | A47B 83/04 248/220.21 |
| 9,181,696 | B1 * | 11/2015 | Bergman | E04B 9/18 |
| 9,187,896 | B1 * | 11/2015 | Bergman | E04B 9/10 |
| 9,187,897 | B1 * | 11/2015 | Bergman | E04B 9/26 |
| 10,113,317 | B1 * | 10/2018 | Laydera-Collins | E04F 13/0858 |
| 2004/0118068 | A1 * | 6/2004 | Kliegle | E04B 9/16 52/506.07 |
| 2006/0157297 | A1 * | 7/2006 | D'Antonio | E04B 9/34 181/290 |
| 2007/0193131 | A1 * | 8/2007 | Ortiz | E04B 9/0478 52/144 |
| 2012/0023853 | A1 * | 2/2012 | Gerkes | E04B 9/225 52/506.06 |
| 2015/0308112 | A1 * | 10/2015 | Holdridge | E04B 9/0478 52/506.08 |
| 2015/0345139 | A1 * | 12/2015 | Underkofler | E04B 9/0435 52/506.08 |
| 2016/0145863 | A1 * | 5/2016 | Bergman | E04B 9/26 52/698 |
| 2016/0208488 | A1 * | 7/2016 | Fladeland | E04B 9/225 |
| 2021/0131101 | A1 * | 5/2021 | Oleske | E04B 9/18 |
| 2022/0136243 | A1 * | 5/2022 | Tanaka | E04C 2/30 52/506.08 |
| 2022/0242790 | A1 * | 8/2022 | Valverde | C04B 41/5089 |
| 2022/0251849 | A1 * | 8/2022 | Simonsen | E04F 13/0821 |
| 2023/0183973 | A1 * | 6/2023 | DePaul et al. | E04B 9/225 52/506.08 |

* cited by examiner

PANEL ELEMENT FOR LINING A CEILING AND/OR WALL, AND LINING FOR A CEILING AND/OR WALL

TECHNICAL FIELD

The invention relates to a panel element for lining a ceiling and/or wall, and to a lining for a ceiling and/or wall.

BACKGROUND

To design ceilings and/or walls, it is known to line ceilings and/or walls using panel elements.

A panel element having the features of the preamble of claim 1 is already known from the document WO 2015/183 632 A1. A hanging ceiling system comprising cover panels fastened to a grid arrangement is already known from the document US 2016 145 863 A1.

In particular when the panel elements are to be fastened to ceilings, it has become conventional to hang panel elements from the ceiling to be lined. In this respect, use is made of retaining springs, for example what are referred to as torsion springs. The retaining springs are fastened at one end to the panel element to be hung up and at the other end to the ceiling and/or wall.

In general, the retaining springs are premounted on a cover panel of a panel element of this type. Although this has advantages for mounting the panel elements, it can make the handling of the panel elements during storage and transport more difficult.

SUMMARY

It is therefore an object of the invention to provide a panel element for lining a ceiling and/or wall that is distinguished by ease of handling.

To achieve the object, what is proposed first of all is a panel element for lining a ceiling and/or wall that has the means and features of the independent claim, which is directed to a panel element of this type. In particular, therefore, to achieve the object, what is proposed is a panel element for lining a ceiling and/or a wall that has a cover panel and at least one retaining spring, which can be moved from a transport position to a fastening position for the purpose of fastening the cover panel to a ceiling or wall, preferably in a suspended manner. The panel element comprises a retaining device for the at least one retaining spring, which according to the invention is configured to fix the at least one retaining spring in its transport position. In this respect, the retaining device can be configured to fix the retaining spring in its transport position under tension.

The retaining device can be used to fix the at least one retaining spring in the transport position on the cover panel. The cover panel is preferably rectangular.

In this way, it is ensured that the retaining spring remains initially in its transport position while the panel element is being handled during transport, storage and when it is being mounted. Damage to the panel element as a result of the retaining spring is thus avoided.

According to the invention, the retaining device is configured to clamp the at least one retaining spring in its transport position. In this way, the retaining spring can be particularly reliably fixed in its transport position.

According to the invention, the at least one retaining spring is preferably fixed on the retaining device by its inherent spring force in the transport position. In this way, the spring force provided by the retaining spring can be utilized to fix the retaining spring in its transport position. This can correspondingly simplify the design of the retaining device.

It should be mentioned at this juncture that the retaining spring can also be fixed in its fastening position by its inherent spring force.

It is possible for the retaining device itself not to have any movable parts. According to the invention, the retaining device is in the form of a preferably static counter-bearing, in order to fix the at least one retaining spring in its transport position under tension preferably by virtue of its inherent spring force.

According to the invention, it is provided that the retaining spring, in particular by way of its spring legs, is closer to a side of the cover panel, specifically a back side of the cover panel, in its transport position than in its fastening position. In this respect, this side may be a side of the cover panel that is not a visible side of the panel element. Here, the retaining spring, in its transport position, may rest against this side of the cover panel, which side is preferably not a visible side of the panel element. In the transport position, the retaining spring and in particular also its spring legs may be aligned parallel or approximately parallel to this side of the cover panel.

In its transport position, the at least one retaining spring may thus be fixed securely to a side of the cover panel that is not a visible side of the panel element. In this way, damage to the visible side of the panel element caused by the at least one retaining spring while being handled during transport and/or storage and even when the panel element is being mounted can be avoided.

The visible side of the panel element may be a side which remains visible in the mounted position of use of the panel element.

The spring legs of the at least one retaining spring may be further apart in the fastening position, that is to say when they are moved out of their transport position to fasten the panel element to a ceiling and/or wall, than in its transport position when the retaining spring is tensioned. In its fastening position, the retaining spring may be relieved of tension or at least be under less tension than in its transport position.

To transfer the retaining spring from its transport position to its fastening position, it may be pivotable on the retaining device fastening position. The retaining device may be designed such that the retaining spring can be pivoted about a pivot axis running along the cover panel. The retaining device may also be designed such that the retaining spring must be moved in a combined pushing and pivoting movement to transfer it from the transport position into its fastening position. For this purpose, the retaining device may have a longitudinal and pivoting guide for the at least one retaining spring.

The retaining spring may be arranged on the retaining device so as to be displaceable from its transport position in its longitudinal direction. The longitudinal direction of the retaining spring may be aligned in the direction of an opening angle of spring legs of the retaining spring.

The retaining device may delimit a pivot angle for pivoting the retaining spring between its transport position and its fastening position to at most 110°, preferably to 90°, in particular with respect to the back side of the cover panel.

In a particularly advantageous embodiment of the panel element, it is provided that the retaining device has a respective retaining opening for each spring leg of the at least one retaining spring. The retaining openings may be designed such that they allow the retaining spring to be moved between its transport position and its fastening position. The two retaining openings may have edges facing away from one another, against which edges the spring legs of the at least one retaining spring bear when the retaining spring is in the transport position, wherein the two edges are at a distance from one another which is dimensioned such that the spring legs of the retaining spring are held tensioned when the retaining spring is in the transport position, and as a result the retaining spring is fixed in its transport position under tension.

To fix the retaining spring in the transport position, but optionally also in the fastening position, it can be advantageous when spring legs of the at least one retaining spring are hook-shaped at their free ends.

In order to be able to fix the retaining spring particularly reliably in its transport position, it can be expedient when the retaining device, adjacent to at least one of the two retaining openings, has an insertion opening for receiving a free, preferably hook-shaped and/or bent, end of one of the spring legs of the at least one retaining spring. After the retaining spring has been introduced by clamping its spring legs into the two retaining openings, the end of at least one of the two spring legs of the at least one retaining spring can be inserted into the above-mentioned insertion opening, and as a result the retaining spring can be secured particularly reliably in its transport position.

Each retaining opening is preferably assigned at least one insertion opening. In this way, the retaining spring in the transport position can be secured in its transport position by inserting the free, preferably hook-shaped and/or bent, ends of its spring legs into the two insertion openings. There, the preferably hook-shaped ends of the spring legs can prevent the retaining spring from being displaced out of its transport position in its direction of longitudinal extent by its spring force, which presses the spring legs apart. This is possible in a particularly reliable manner when the hook-shaped ends of the spring legs engage behind a respective edge of the insertion openings in the process. The spring legs may be bent at their free ends by between 100° and 200°, and preferably by 180°.

The retaining opening mentioned above may have a first opening portion and a second opening portion. The spring legs may be positioned in the first opening portion when the retaining spring is in the transport position. The spring legs may be arranged in the second opening portion when the retaining spring is in the fastening position.

To introduce force into the retaining device, it may be advantageous when a retaining web, which fixes the retaining spring, in the fastening position, on the retaining device by way of an intermediate portion arranged between spring legs, is formed between two retaining openings of the retaining device that are assigned to a retaining spring, in particular between two second opening portions.

The first opening portion, preferably each first opening portion, in this respect can be delimited in the pivoting direction of the retaining spring toward its fastening position by an opening edge, which secures the spring leg associated to it in a form fit in the transport position. This makes it possible to fix the at least one retaining spring particularly reliably in its transport position.

In one embodiment of the panel element, it is provided that the first opening portion is closer to one side of the cover panel than the second opening portion, which side is not a visible side of the panel element, for example closer to the back side, already mentioned above, of the cover panel.

In this respect, the first opening portion may span a larger angle with the side already mentioned above, in particular with the back side of the cover panel, than the second opening portion. In one embodiment of the panel element, it is provided that the second opening portion is aligned parallel to the above-mentioned side, in particular to the back side of the cover panel. It is then preferably the case that the first opening portion is aligned at a right angle, on the one hand to the above-mentioned side, in particular the back side of the cover panel, and on the other hand to the second opening portion of the retaining device.

It should be mentioned at this juncture that the two opening portions of the retaining opening are connected to one another, with the result that the respective spring leg positioned in the retaining opening can be moved from the one to the other opening portion, in order to transfer the torsion spring from the transport position to its fastening position, and vice versa.

The first opening portion and the second opening portion may be aligned at an angle of less than 180° in relation to one another. The first opening portion and the second opening portion may preferably span an angle between 80° and 110° in relation to one another. As already mentioned above, it is preferred when an angle of 90° can be measured between the first opening portion and the second opening portion.

In an advantageous embodiment of the panel element, it is provided that the retaining device comprises a profile, in particular an edge profile, which is arranged or formed on the cover panel. The profile may preferably be arranged or formed on a side of the cover panel that is not a visible side of the panel element, for example on the above-mentioned back side of the cover panel.

The above-mentioned retaining openings may in this respect be formed in the profile of the retaining device.

The profile may be shaped, for example, by bending the cover panel. In another embodiment, the profile is arranged or formed on one side, in particular on the back side of the cover panel.

The profile may have a first profile leg which adjoins the above-mentioned side, in particular the back side of the cover panel. The first opening portion of the retaining openings may be formed in this profile leg. The profile may furthermore also have a second profile leg, in which the second opening portions of the retaining openings can then be formed. The second profile leg may be arranged opposite that side of the cover panel that was already mentioned above, in particular its back side. It is also possible to arrange the first profile leg between the cover panel and the second profile leg.

The panel element may have a stop, by means of which the panel element can be positioned against a mount, for example against a retaining profile, on a ceiling or wall in the mounted position of use. The stop may be in the form of a stop leg, which is aligned transversely or at right angles to the cover panel, in particular to the back side of the cover panel. The stop leg may be a profile leg, in particular a third profile leg of the above-mentioned profile of the panel element.

In one embodiment of the panel element, it is provided that at least one respective retaining device of at least one retaining spring is arranged on two edges that face away from one another.

In one embodiment of the panel element, at least two retaining springs are arranged on one edge of the cover panel. Of course, it is also conceivable to arrange two retaining springs on one edge of the cover panel and two further retaining springs on a second edge of the cover panel that faces away from or is situated opposite the first edge.

The cover panel of the panel element may consist at least partially of metal. It is preferably provided that the cover panel consists completely of metal.

To achieve the object, what is lastly also proposed is a lining for a ceiling and/or wall, having at least one mount that can be fastened to a ceiling and/or wall and is fastened in the use position, and having at least one panel element as claimed in one of the claims directed to such a panel element. In this respect, it is provided that, in its use position, the panel element is fastened to the mount by way of its at least one retaining spring. In this respect, it is possible to hook the retaining spring into the mount in order to fasten the panel element. In this case, the retaining spring can assume a position in which it is relieved of tension, or at least is under less tension, in comparison with its tensioned transport position, and in which its spring legs are spaced apart to a greater extent than when the retaining spring is in the transport position. The mount of the lining may be a retaining profile, into which the at least one retaining spring can be hooked.

The mount may have at least one retaining hole, for example a slot, for each retaining spring. Spring legs of the retaining spring can be guided through the retaining hole and then spread apart by the spring force of the retaining spring. In this way, the panel element can be fastened to the mount in a form fit, and primarily also detachably, with the aid of its at least one retaining spring.

At least one securing receptacle, in particular at least one securing hole, for receiving a hook-shaped end of a spring leg of a retaining spring may be assigned to the above-mentioned retaining hole. By way of its hook-shaped end, a spring leg of a retaining spring may engage into this at least one securing receptacle, for example in order to first of all hang up the panel element on the mount while it is being mounted and/or in order to intercept the panel element if it should become detached from its correct position of use, as can possibly occur for instance on account of strong tremors in the event of an earthquake. In this way, the at least one securing receptacle can be used as an arrester for a panel element of the lining.

This type of arrester is particularly reliable when a respective securing receptacle is provided on either side of a retaining hole. It is thus possible for each one of two of the above-mentioned hook-shaped ends of the spring legs of a retaining spring to engage in one of the two securing receptacles in order to hand up the panel element on the mount in a position favoring its mounting, or in order to intercept the panel element if it should become detached from its correct mounting position. It is thus possible to reliably prevent the panel element of the lining from falling, for example in the event of an earthquake.

Two securing receptacles of this type may be assigned to each retaining hole of the mount through which the spring legs of a retaining spring of a panel element are to be guided. It is thus possible to secure the panel element by way of multiple, and preferably by way of all of the retaining springs against falling.

BRIEF DESCRIPTION OF THE DRAWINGS

The invention will now be described in more detail on the basis of an exemplary embodiment, but is not restricted to this exemplary embodiment. Further exemplary embodiments will emerge from the combination of the features of individual or multiple patent claims with one another and/or in the combination of individual or multiple features of the exemplary embodiment. In the figures:

DETAILED DESCRIPTION

All of the figures show at least part of a panel element, denoted 1 overall, for lining a ceiling and/or wall. The panel element 1 has a rectangular cover panel 2 and multiple retaining springs 3. The retaining springs 3 are so-called leg springs, which are also referred to as torsion springs.

Figure 1:
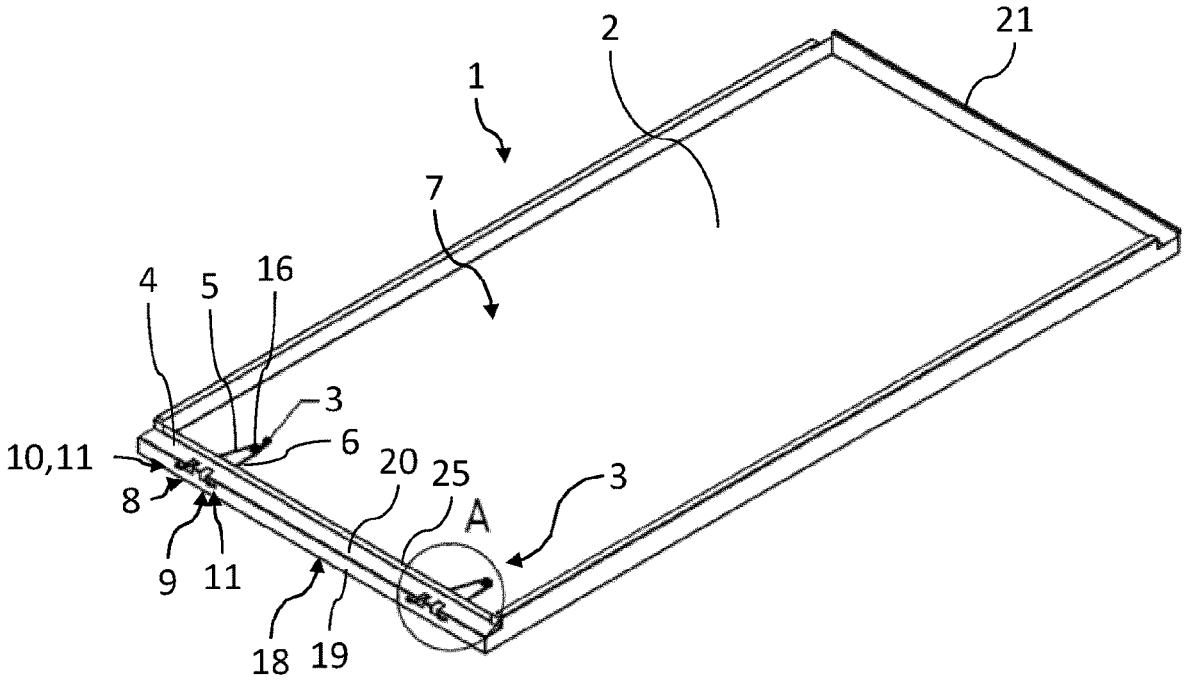
FIG. 1 shows a perspective rear view of a panel element with two retaining springs.
Figure 2:
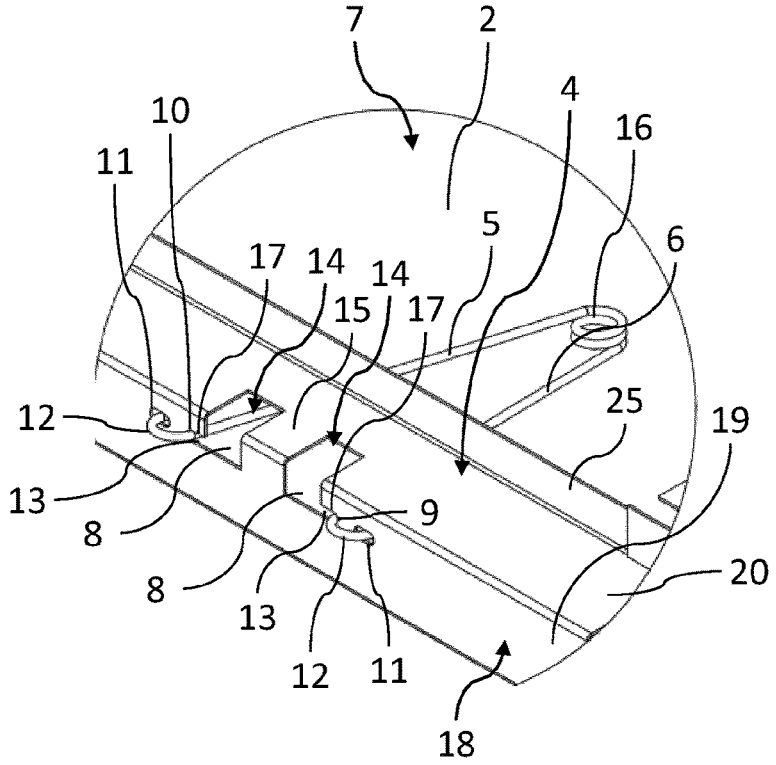
FIG. 2 shows an enlarged illustration of the detail marked by the circle A in FIG. 1.
Figure 3:
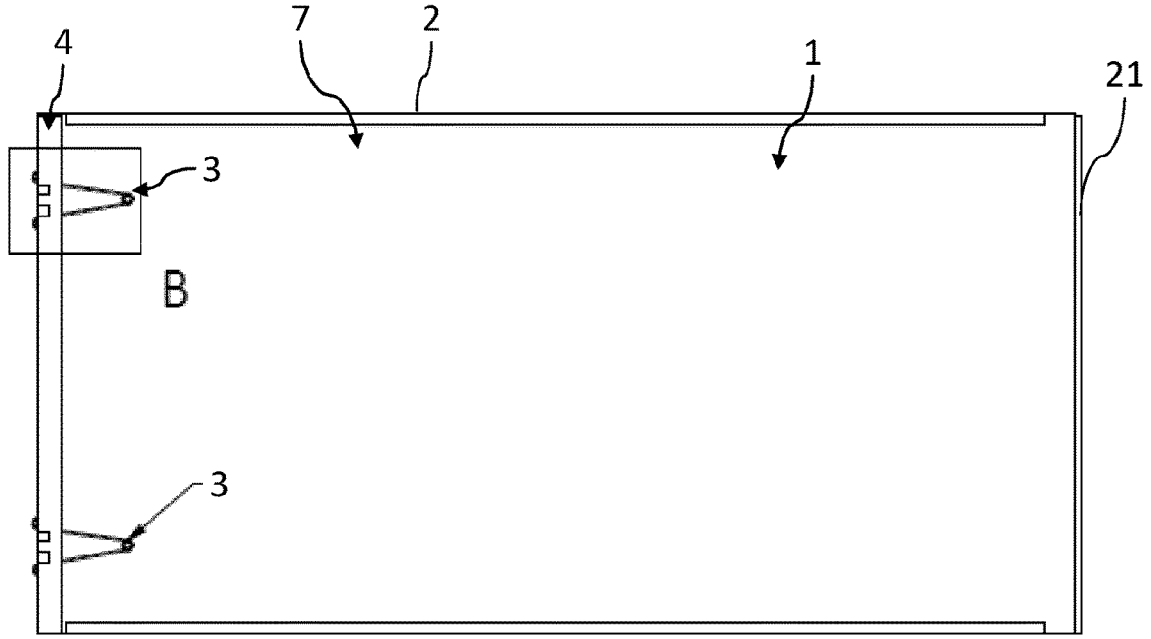
FIG. 3 shows a plan view of the panel element illustrated in the previous Figures.
Figure 4:
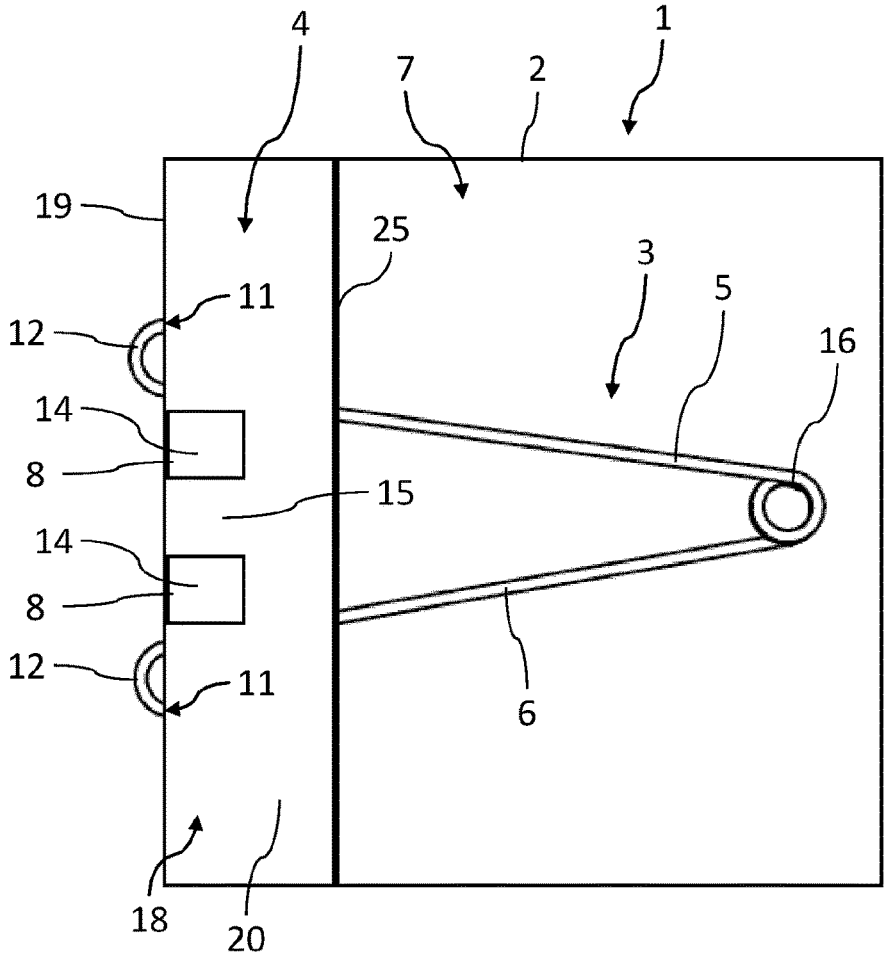
FIG. 4 shows an enlarged illustration of the detail marked by the rectangle B in FIG. 3.
Figure 5:
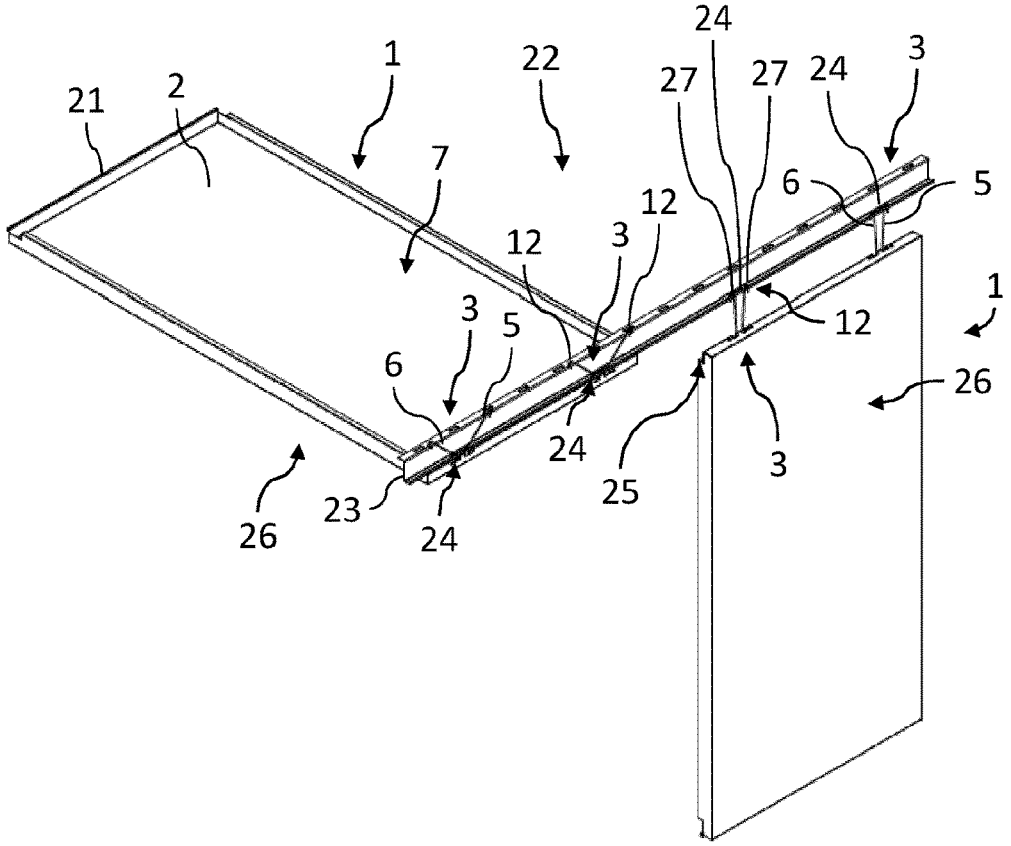
FIG. 5 shows two panel elements on a mount for lining a ceiling.
Figure 6:
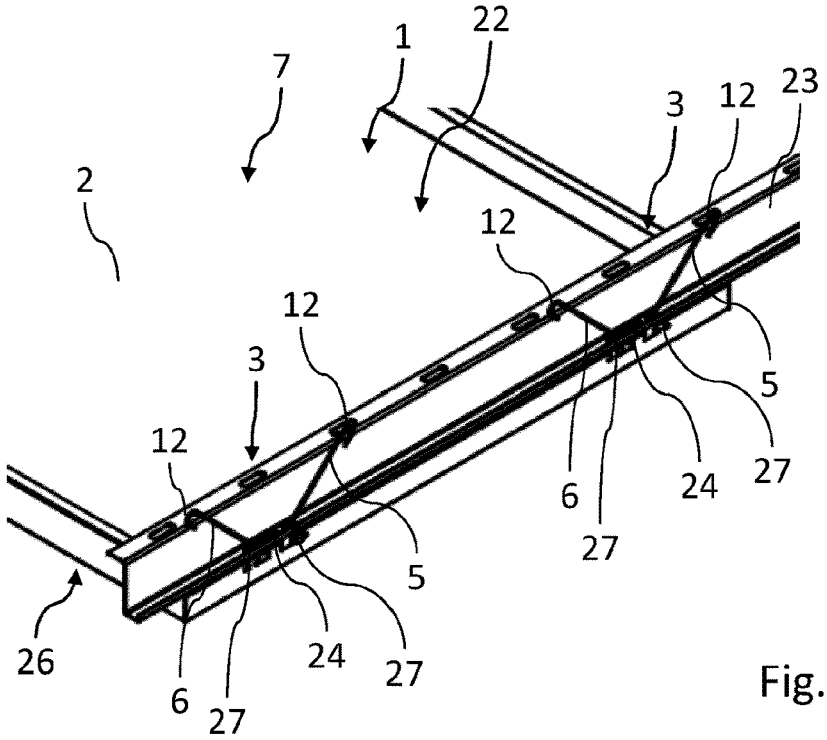
FIG. 6 shows an enlarged detail from FIG. 5 to illustrate the function of the retaining springs of the panel elements on the mount.

To fasten the cover panel 2 to a ceiling and/or wall in a suspended manner, the retaining springs 3 can be transferred from their transport positions, shown for example in FIGS. 1 to 4, to a fastening position, in which some retaining springs 3 are illustrated in FIGS. 5 and 6.

The retaining springs 3 are fastened to the cover panel 2 of the panel element 1 by means of a retaining device 4.

FIGS. 1 to 4 illustrate that the retaining device 4 is configured to fix the retaining springs 3 in their respective transport position. In this way, the retaining springs 3 are securely immobilized in their transport position on the cover panel 2 of the panel element 1. According to the exemplary embodiment, shown in the figures, of the panel element 1, the retaining device 4 is configured to fix the retaining springs 3 in their respective transport positions under tension. The retaining device 4 is designed such that the retaining springs 3 are fixed in their transport position by their inherent spring force. In this respect, the retaining device 4 acts as a static counter-bearing for fixing the retaining springs 3 in their transport position under tension.

A comparison of FIGS. 1 to 4 with FIGS. 5 and 6 makes it clear that the retaining springs 3, by way of its spring legs 5, 6, is closer to a side of the cover panel 2 that is not a visible side 26 of the mounted panel element 1 in its transport position than in its fastening position. The side closer to which the retaining springs 3 are by way of their spring legs 5, 6 in the transport position is a back side 7 of the cover panel 2.

By way of their spring legs 5, 6, the retaining springs 3 are aligned approximately parallel to the back side 7 in the transport position. The spring legs 5, 6 of the at least one retaining spring 3 are further apart in its fastening position than in its transport position. Consequently, the retaining springs 3 are under greater tension in the transport position than in the fastening position.

In order to transfer the retaining springs 3 from their transport position to their fastening position, the retaining springs 3 can be pivoted on the retaining device 4. A pivot axis about which the pivoting movement of the retaining springs 3 takes place runs along the cover panel 2 of the panel element 1 here. Upon viewing the figures, it becomes clear that the pivoting movement constitutes merely one movement component for transferring the retaining springs 3 from their transport position to their fastening position. Before the retaining springs 3 can be pivoted on the retaining device 4, in the exemplary embodiment illustrated in the figures they must be moved by way of a longitudinal movement aligned in the direction of their longitudinal extent and in the direction of an opening angle of their spring legs 5, 6. For this, the retaining device 4 provides a combined longitudinal and pivoting guide for the retaining springs 3. Thus, the retaining springs 3 are arranged on the retaining device 4 also so as to be displaceable from their transport position in their longitudinal direction.

The retaining device 4 delimits a pivot angle of the retaining springs 3 between their respective transport position and their respective fastening position to at most 110°. In the exemplary embodiment, shown in the figures, of the panel element 1, the pivot angle of the retaining springs 3 between their transport position and their fastening position is delimited to 90°.

The retaining device 4 has a respective retaining opening 8 for each spring leg 5, 6 of the two retaining springs 3. The two retaining openings 8 assigned to one retaining spring 3 have edges 9, 10 that face away from one another. According to the figures, these edges 9, 10 are aligned at right angles to the back side 7 of the cover panel 2. When the retaining spring 3 is in the transport position, the spring legs 5, 6 of the retaining springs 3 bear against these edges 9, 10. The edges 9, 10 are at a distance from one another which is dimensioned such that the spring legs 5, 6 of the retaining springs 3 are held tensioned when the retaining springs 3 are in the transport position. As a result, the retaining springs 3 are fixed in their transport position under tension. The tension for fixing the retaining springs 3 is created in this case by the respective retaining spring 3 by virtue of its inherent spring force itself.

The spring legs 5, 6 of the retaining springs 3 are hook-shaped at their free ends. The retaining springs 3 can be hooked into a mount 23 by way of their hook-shaped ends, as is shown for example in the right-hand half of FIG. 5. This facilitates the mounting of the panel element 1.

The retaining device 4 of the panel element 1 has insertion openings 11 adjacent to the retaining openings 8. The insertion openings 11 serve to receive a respective free, hook-shaped, bent end 12 of the spring legs 5, 6 of the retaining springs 3. The hook-shaped ends 12, positioned in the insertion openings 11, of the spring legs 5, 6 prevent the retaining springs 3 from being displaced out of their transport position in their direction of longitudinal extent by their spring force, which presses the spring legs 5, 6 apart. This is possible in a particularly reliable manner when the hook-shaped ends 12 of the spring legs 5, 6 engage behind a respective edge of the insertion openings 11 in the process. The spring legs 5, 6 may be bent at their hook-shaped ends 12 by between 100° and 200°, in particular by 180°.

The retaining openings 8 each comprise a first opening portion 13 and a second opening portion 14. When the retaining spring 3 is in the transport position, the spring legs 5, 6 are placed in the first opening portion 13 and, when the retaining spring 3 is in the fastening position, they are placed in the second opening portion 14 of the retaining openings 8.

The retaining device 4 has a respective retaining web 15 between two retaining openings 8 assigned to one retaining spring 3, specifically between two second opening portions 14. The retaining web 15 fixes each of the retaining springs 3, in the fastening position, on the retaining device 4, and therefore on the cover panel 2 of the panel element 1, by way of an intermediate portion 16 arranged between the spring legs 5, 6. The intermediate portion 16 is in the form of an eye, which consists of turns of a wire from which the retaining springs 3 are each made.

The respective first opening portion 13 of the retaining openings 8 is delimited by an opening edge 17 in the pivoting direction of the retaining springs 3 toward their respective fastening position. The opening edge 17 is provided to secure the spring legs 5, 6, which are in the first opening portion 13 in the transport position, of the retaining spring 3 toward the fastening position of the retaining spring 3 in a form fit. In the case of the panel element 1 shown in the figures, the opening edge 17 is aligned parallel to the back side 7 of the cover panel 2 of the panel element 1.

The first opening portions 13 of the retaining openings 8 are arranged closer to the back side 7 of the cover panel 2 than the second opening portions 14. Here, the first opening portion 13 of the retaining opening 8 spans a larger angle with the back side 7 of the cover panel 2 than the second opening portion 14, which is aligned parallel to the rear side 7 of the cover panel 2 in the exemplary embodiment shown. Here, the angle amounts to 90°. The first opening portion 13 and the second opening portion 14 of the retaining openings 8 are therefore aligned at an angle of less than 180° in relation to one another.

The retaining device 4 comprises a profile 18, which is arranged on an edge of the cover panel 2 and therefore can be referred to as edge profile. The above-mentioned retaining openings 8 are formed in the profile 18. The profile 18 comprises a first profile leg 19, in which the first opening portions 13 of the retaining device 8 are formed. The profile 18 furthermore also comprises a second profile leg 20, in which the second opening portions 14 of the retaining openings 8 are formed.

In the exemplary embodiment, shown in the figures, of the panel element 1, the profile 18 is shaped by bending the cover panel 2 on the back side 7 of the cover panel 2. In an exemplary embodiment which is not shown in the figures, a profile 18 is fastened or integrally formed on a side of the cover panel 2 that preferably is not a visible side 26 of the panel element 1.

In one embodiment, not shown in the figures, of the panel element 1, it is provided that the respective at least one retaining device 4 with at least one retaining spring 3 is arranged on two edges of the cover panel 2 that face away from one another. In the exemplary embodiment, shown in the figures, of the panel element 1, two retaining springs 3 are arranged on an edge of the cover panel 2.

The cover panel 2 of the panel element 1 illustrated in the figures consists of metal. The cover panel 2 can be hooked into a correspondingly formed retaining structure by way of its retaining edge 21 facing away from the retaining device 4 for the purpose of fastening the ceiling element 1.

On the one side, the panel element 1 is held on the ceiling by the two retaining springs 3, while on the other side it can be fastened at least indirectly to the ceiling or wall with the aid of its retaining edge 21.

Now, FIGS. 5 and 6 show a lining for a ceiling and/or wall, which lining is denoted 22 overall. The lining 22 comprises multiple panel elements 1 that are shown in FIGS. 1 to 4 and at least one mount 23 fastened to the ceiling and/or wall in the use position. The panel elements 1 are fastened to the mount 23 by way of their retaining springs 3 in their use position. To that end, the retaining springs 3 are hooked into the mount 23 by way of their spring legs 5, 6. The mount 23 is in the form of a retaining profile and, for the purpose of hooking in the spring legs 5, 6, has multiple retaining holes 24 in the form of slots.

FIG. 5 illustrates the mounting of the panel elements 1. First of all, the retaining springs 3 are pushed out of their respective transport position in the longitudinal direction.

Then, the retaining springs 3 are guided through the retaining holes 24 of the mount 23 by way of the hook-shaped ends of their spring legs 5, 6, and hooked into securing receptacles 27, present on either side of the retaining holes 24, of the mount 23 in order to hang up the panel element 1. In the process, the back side 7 of the cover panel 3 is aligned approximately in or in the direction of gravity (see right-hand half of FIG. 5). After that, the panel element 1 thus hung up is lifted up by 90°, hooked into a retaining rail, which is fastened to the ceiling, by way of its retaining edge 21, and pushed in the direction of the ceiling counter to the direction of gravity. In the process, the spring legs 5, 6 on the one hand enter the second opening portions 14 of the retaining openings 8. On the other hand, the spring legs 5, 6 slip further through the retaining holes 24 and spread apart owing to the spring force of the retaining springs 3, as a result of which the panel element 1 can be hung up correctly.

The panel elements 1 can become detached from their intended mounting position if strong vibrations and/or tremors act on them, for example in the event of an earthquake. If the panel elements 1 inadvertently become detached from their intended mounting position, the panel elements 1 can be intercepted with the aid of the hook-shaped ends 12 of the spring legs 5, 6 of their retaining springs 3 and the securing receptacles 27 and can be prevented from falling. If the panel elements 1 become detached, the spring legs 5, 6 slip through the retaining holes 24 until the hook-shaped ends 12 of the spring legs 5, 6 of the retaining springs 3 engage in the securing receptacles 27. The hook-shaped ends 12 remain there, securing the panel element 1 against falling.

The hook-shaped ends 12 of the retaining springs 3 of the right-hand panel element 1 of FIG. 5 engage in the securing receptacles 27. It can be seen that the securing receptacles 27 introduced in the mount 23 are continuous securing holes.

The panel element 1 has a stop in the form of a stop leg 25, by way of which it can bear against the mount 23 in the correct position of use. The stop leg 25 is a third profile leg of the profile 18 and is aligned at right angles to the back side 7 of the cover panel 2 and/or at right angles to the second profile leg 20.

The invention is concerned with improvements to the technical field of panel elements for lining ceilings and/or walls. To that end, what is proposed, inter alia, is a panel element 1 which has a retaining device 4, by means of which at least one retaining spring 3, which is used to fasten the panel element 1 to the ceiling and/or wall, can be fixed in its transport position.

LIST OF REFERENCE SIGNS

1 Panel element
2 Cover panel
3 Retaining spring
4 Retaining device
5 Spring leg
6 Spring leg
7 Back side of 2
8 Retaining opening
9 Edge of 8
10 Edge of 8
11 Insertion opening
12 Hook-shaped end of 5, 6
13 First opening portion of 8
14 Second opening portion of 8
15 Retaining web
16 Intermediate portion
17 Opening edge of 13
18 Profile
19 First profile leg
20 Second profile leg
21 Retaining edge
22 Lining
23 Mount
24 Retaining hole
25 Bearing leg
26 Visible side
27 Securing receptacle

The invention claimed is:

1. A panel element (1) for lining a ceiling and/or wall, the panel element (1) comprising:

a cover panel (2);

at least one retaining spring (3) which is movable from a transport position to a fastening position for fastening the cover panel (2) to a ceiling and/or wall;

a retaining device (4) for the at least one retaining spring (3), the retaining device (4) is configured to fix the at least one retaining spring (3) in the transport position under tension, and the retaining device (4), for tensioned fixing of the at least one retaining spring (3) in the transport position, the retaining device (4) comprises a counter-bearing and the at least one retaining spring (3) is fixed on the retaining device (4) in the transport position by an inherent spring force;

the at least one retaining spring (3) is closer to a back side (7) of the cover panel (2) in the transport position than in the fastening position;

the at least one retaining spring includes spring legs (5, 6), and the retaining device (4) has a respective retaining opening (8) for each said spring leg (5, 6); and the retaining openings (8) have edges (9, 10) facing away from one another, against which edges the spring legs (5, 6) of the at least one retaining spring (3) bear when the retaining spring (3) is in the transport position, and two of the edges (9, 10) are at a distance from one another which is dimensioned such that the spring legs (5, 6) of the retaining spring (3) are held tensioned when the retaining spring (3) is in the transport position, and as a result the retaining spring (3) is fixed in the transport position under tension.

2. The panel element (1) as claimed in claim 1, wherein the counter-bearing is a static counter-bearing for the tensioned fixing of the at least one retaining spring (3) in the transport position.

3. The panel element (1) as claimed in claim 1, wherein at least one of a) the at least one retaining spring (3) includes spring legs (5, 6), and is closer via the spring legs to the back side (7) of the cover panel (2) in the transport position than in the fastening position, or b) the at least one retaining spring (3), in the transport position, rests against the back side (7) of the cover panel (2).

4. The panel element (1) as claimed in claim 1, wherein the at least one retaining spring (3) includes spring legs (5, 6) which are further apart in the fastening position than in the transport position.

5. The panel element (1) as claimed in claim 1, wherein at least one of a) the retaining spring (3) is pivotable on the retaining device (4) from the transport position into the fastening position, or b) the retaining device (4) has a combined longitudinal and pivoting guide for the at least one retaining spring (3), such that the at least one retaining spring (3) is arranged on the retaining device (4) so as to be displaceable from the transport position in a longitudinal direction thereof.

6. The panel element (1) as claimed in claim 1, wherein the retaining device (4) delimits a pivot angle for pivoting the retaining spring (3) between the transport position and the fastening position to at most 110°.

7. The panel element (1) as claimed in claim 1, wherein the retaining device (4), adjacent to at least one of the two retaining openings (8), has an insertion opening (11) for receiving a free end (12) of one of the two spring legs (5, 6) of the at least one retaining spring (3), and ends (12) of the spring legs (5, 6) are bent by between 100° and 200°.

8. The panel element (1) as claimed in claim 1, wherein the retaining device (4) comprises at least one profile (18) which is arranged or formed on the cover panel (2).

9. The panel element (1) as claimed in claim 8, wherein the retaining openings (8) are formed in the at least one profile (18), and the at least one profile (18) has a first profile leg (19) with first opening portions (13) of the retaining openings and a second profile leg (20) with second opening portions (14) of the retaining openings.

10. The panel element (1) as claimed in claim 9, wherein the profile (18) is shaped by bending the cover panel (2), the profile (18) is fastened to or integrally formed on one side of the cover panel (2).

11. The panel element (1) as claimed in claim 1, wherein at least one said respective retaining device (4) with at least one said retaining spring (3) is arranged on each of two edges of the cover panel (2) that face away from one another.

12. The panel element (1) as claimed in claim 1, wherein the cover panel (2) is formed at least partially of metal.

13. A lining (22) for a ceiling and/or wall, comprising:

at least one mount (23) that is fastenable to a ceiling and/or wall and is fastened in a use position, and at least one panel element (1) as claimed in claim 1, wherein, in the use position, the panel element (1) is fastened to the mount (23) by the at least one retaining spring (3).

14. The lining (22) as claimed in claim 13, wherein at least one of a) the retaining spring (3) is hooked into the mount (23) or b) the mount (23) is a retaining profile.

15. The lining (22) as claimed in claim 14, wherein the mount (23) has at least one retaining hole (24) for each said retaining spring (3), and at least one securing receptacle (27) for receiving a hook-shaped end (12) of a spring leg (5, 6) of the retaining spring (3) is assigned to at least one retaining hole (24).

16. A panel element (1) for lining a ceiling and/or wall, the panel element (1) comprising:

a cover panel (2);

at least one retaining spring (3) which is movable from a transport position to a fastening position for fastening the cover panel (2) to a ceiling and/or wall;

a retaining device (4) for the at least one retaining spring (3), the retaining device (4) is configured to fix the at least one retaining spring (3) in the transport position under tension, and the retaining device (4), for tensioned fixing of the at least one retaining spring (3) in the transport position, the retaining device (4) comprises a counter-bearing and the at least one retaining spring (3) is fixed on the retaining device (4) in the transport position by an inherent spring force;

the at least one retaining spring (3) is closer to a back side (7) of the cover panel (2) in the transport position than in the fastening position;

the at least one retaining spring includes spring legs (5, 6), and the retaining device (4) has a respective retaining opening (8) for each said spring leg (5, 6); and each said retaining opening (8) has a first opening portion (13) and a second opening portion (14), and the spring legs (5, 6) are arranged in the first opening portion (13) when the retaining spring (3) is in the transport position and are arranged in the second opening portion (14) when the retaining spring (3) is in the fastening position.

17. The panel element (1) as claimed in claim 16, further comprising a retaining web (15), which fixes the retaining spring (3), in the fastening position, on the retaining device (4) by an intermediate portion (16) of the retaining spring arranged between spring legs (5, 6), formed between two of the retaining openings (8) of the retaining device (4) that are assigned to one said retaining spring (3).

18. The panel element (1) as claimed in claim 17, wherein the first opening portion (13) is delimited in the pivoting direction of the retaining spring (3) toward the fastening position by an opening edge (17), which secures the respective spring leg (5, 6) of the retaining spring (3) in a form fit in the transport position.

19. The panel element (1) as claimed in claim 18, wherein at least one of a) the first opening portion (13) is closer to one side of the cover panel (2) than the second opening portion (14), which side is not a visible side (26) of the panel element (1), b) the first opening portion (13) spans a larger angle with one side of the cover panel (2) than the second opening portion (14), or c) the second opening portion (14) is aligned parallel to one side of the cover panel (2).

20. The panel element (1) as claimed in claim 19, wherein the first opening portion (13) and the second opening portion (14) are aligned at an angle less than 180° in relation to one another.

* * * * *